US009612048B2

(12) United States Patent
Kim

(10) Patent No.: US 9,612,048 B2
(45) Date of Patent: Apr. 4, 2017

(54) ICE MAKING APPARATUS OF REFRIGERATOR AND ASSEMBLING METHOD THEREOF

(75) Inventor: Bumseup Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 522 days.

(21) Appl. No.: 13/593,872

(22) Filed: Aug. 24, 2012

(65) Prior Publication Data

US 2013/0047645 A1 Feb. 28, 2013

(30) Foreign Application Priority Data

Aug. 26, 2011 (KR) ..... 10-2011-0086062

(51) Int. Cl.

| | |
|---|---|
| ***F25B 39/02*** | (2006.01) |
| ***G01K 1/14*** | (2006.01) |
| ***F25C 1/04*** | (2006.01) |
| ***F25C 1/10*** | (2006.01) |
| ***F25C 5/06*** | (2006.01) |

(52) U.S. Cl.

CPC ..... *F25C 1/04* (2013.01); *F25C 5/06* (2013.01); *F25C 2305/022* (2013.01); *F25C 2700/12* (2013.01); *F25D 2400/40* (2013.01); *Y10T 29/49359* (2015.01)

(58) Field of Classification Search

CPC .... F25C 2500/02; F25C 1/04; F25C 2300/00; F25C 3/00; F25C 1/10; F25C 5/08; F25C 1/08; F25C 5/187; F25B 39/02; F28F 2265/30; G01K 1/14

USPC ..... 62/125, 135, 515, 351, 340, 353, 344, 62/137; 29/890.035; 374/208; 73/431

See application file for complete search history.

(56) References Cited

U.S. PATENT DOCUMENTS 2,844,008 A * 7/1958 Barton ..... F25C 1/04 62/135
4,665,708 A * 5/1987 Tate, Jr. ..... F25C 1/04 62/66
5,056,321 A * 10/1991 Patrick ..... 62/73

(Continued)

FOREIGN PATENT DOCUMENTS

GB 998056 7/1965
JP 1996-327199 12/1996

(Continued)

OTHER PUBLICATIONS

European Search Report issued in EP Application No. 12181709.2 dated Mar. 28, 2013.

*Primary Examiner* — Frantz Jules
*Assistant Examiner* — Meraj A Shaikh
(74) *Attorney, Agent, or Firm* — Ked & Associates, LLP

(57) ABSTRACT

An ice making apparatus of a refrigerator and a method for assembling such an ice making apparatus are provided. The ice making apparatus may include an ice tray, a sensor installed on a lower portion of the ice tray, a sensor wire connecting the sensor to a controller of the refrigerator, a driver provided at a first end of the ice tray, a driving shaft provided at the first end of the ice tray, a support device provided at a second end of the ice tray, and a support shaft provided at the second end of the ice tray and inserted into a rotational shaft hole of the support device, the support shaft having a through hole allowing the sensor wire to pass therethrough.

6 Claims, 3 Drawing Sheets

(56) References Cited

U.S. PATENT DOCUMENTS

| | | | | |
|---|---|---|---|---|
| 8,245,527 | B2 * | 8/2012 | Ducharme | F25C 1/10 62/340 |
| 8,806,937 | B2 * | 8/2014 | Hatano | G01K 1/14 73/431 |
| 2006/0162350 | A1 * | 7/2006 | Shiraishi | F25B 39/02 62/125 |
| 2009/0296782 | A1 * | 12/2009 | Nishiyashiki | G01K 1/14 374/208 |
| 2012/0017626 | A1 * | 1/2012 | Hwang et al. | 62/340 |

FOREIGN PATENT DOCUMENTS

| | | | | |
|---|---|---|---|---|
| JP | 08327199 | A | * | 12/1996 |
| JP | 2005-257114 | | | 9/2005 |
| JP | 2005257114 | A | * | 9/2005 |

* cited by examiner

ICE MAKING APPARATUS OF REFRIGERATOR AND ASSEMBLING METHOD THEREOF

CROSS-REFERENCE TO RELATED APPLICATION(S)

This application claims priority under 35 U.S.C. §119 to Korean Application No. 10-2011-0086062, filed in Korea on Aug. 26, 2011, whose entire disclosure is hereby incorporated by reference.

BACKGROUND

1. Field

This relates to an ice making apparatus of a refrigerator and an assembling method thereof.

2. Background

A refrigerator may store items at a low temperature, in either a refrigerated or frozen state as appropriate for the particular item. Cold air may be continuously supplied to the interior of the refrigerator by repetition of a refrigerating cycle including compression-condensation-expansion-evaporation of refrigerant.

BRIEF DESCRIPTION OF THE DRAWINGS

The embodiments will be described in detail with reference to the following drawings in which like reference numerals refer to like elements wherein.

DETAILED DESCRIPTION

An ice making apparatus of a refrigerator and an assembling method thereof according to embodiments will now be described in detail.

The terms and words used herein are not necessarily limited to typical meanings or dictionary definitions, but may be construed as having meanings and concepts relevant to the technical scope of embodiments as broadly described herein that may appropriately define the concept to one of ordinary skill in the art. Therefore, embodiments as broadly described herein should not be construed as limiting and may include various changes, equivalents, and substitutions included in the spirit and scope of the embodiments as broadly described herein.

In a refrigerator, a refrigerating chamber, a freezing chamber, and an ice making chamber may be formed within a main body of a refrigerator. The ice making chamber may be provided with the freezing chamber or the refrigerating chamber, or on or door which opens and closes one of the refrigerating chamber or the freezing chamber. Cooled air may be generated by a refrigerating cycle and supplied through a cold air duct, or the like, to the interior of the main body of the refrigerator by one or more fans, and distributed amongst the refrigerating chamber, freezing chamber and ice making chamber as appropriate. An ice making apparatus for making ice may be provided within the ice making chamber, and may include an ice maker and a water supply device.

Figure 1:
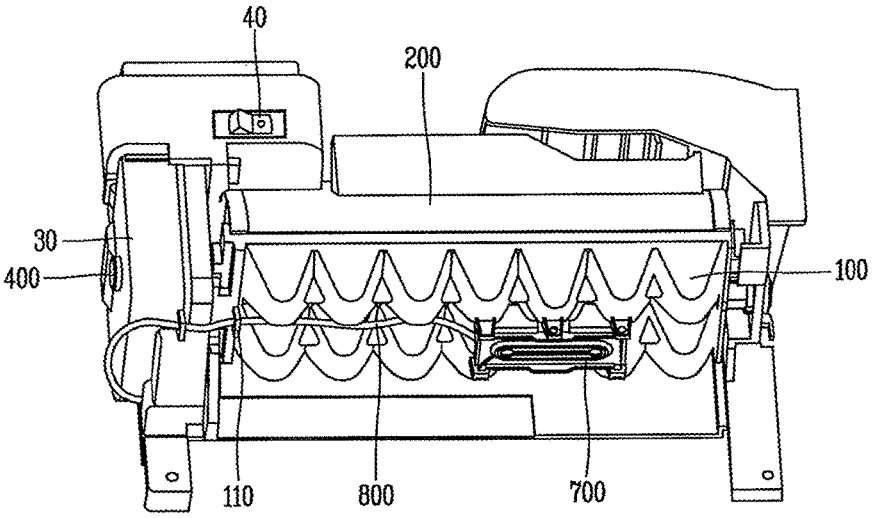
FIG. 1 illustrates an exemplary ice making apparatus installed in a refrigerator.

The exemplary ice maker shown in FIG. 1 may include a driver 30, an ice tray 100 including a plurality of cells in which water may be received to make ice, the ice making tray 100 being connected to the driver 30 by a driver rotational shaft 400, and an ice storage container provided under the ice tray 100 for storing ice. The driver 30 may include, for example, a circuit board on which a controller including a microcomputer, or the like, is mounted, and mechanical driving devices such as a motor, a gear decelerating and amplifying movement of the motor and transferring the same to the rotational shaft 400, which may output the transferred movement. Various sensors may sense a rotational state of the rotational shaft 400 to control a rotational operation of the ice tray 100, and a tray hood or cover 200 may be installed at an upper portion of the ice tray 100. A plurality of sensors may sense, for example, a temperature, a horizontal position, and the like, of the ice tray 100, and may be attached as a sensor device 700 under the ice tray 100. A sensor wire 800 transmitting data measured by the sensor device 700 to a controller 900 of the refrigerator may be tightly attached to a lower surface of the ice tray 100 and guided toward the driver 30.

Because the ice tray 100 may be rotated by approximately 180 degrees by the rotational shaft 400, the sensor wire 800 may be installed as close as possible to the rotational shaft 400. To this end, as shown in FIG. 1, a sensor wire through hole 110 may be provided at a lower portion of an end of the ice tray 100 adjacent to the rotational shaft 400 to guide and fix a position of the sensor wire 800.

After water is supplied to the cells of the ice tray 100 and an ice making step is performed to freeze the water into ice, the ice tray 100 may be rotated by the driver 30 to release ice, in an ice releasing step. The released ice may then be stored in the ice storage container.

However, when the ice tray 100 is rotated and a position thereof reversed changed by approximately 180 degrees to allow the ice to fall into the ice storage container, the wire 800 may be twisted and caught between the ice tray 100 and the driver 30, and broken. In particular, since the sensor wire 800 is installed within a tube having a certain thickness, if the sensor wire 800 is relatively thick, the sensor wire 800 may be more easily caught between the ice tray 100 and the driver 30, causing malfunction of the ice tray 100 as it rotates, and possible malfunction of the ice making apparatus. Rotation of the ice tray 100 may also cause the sensor wire 800 to be caught by the cover 200 and damaged.

Figure 2:
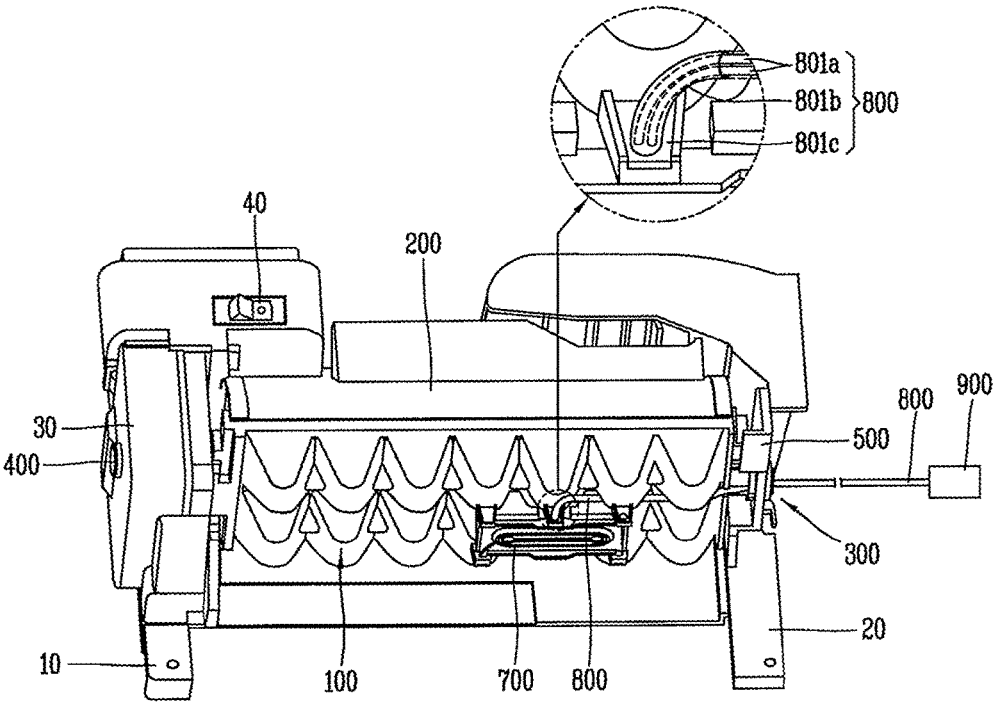
FIG. 2 is a lower perspective view of an ice making apparatus in which a sensor wire is drawn out, in accordance with an embodiment as broadly described herein.

As shown in FIG. 2, an ice making apparatus of a refrigerator according to an embodiment as broadly described herein may include an ice tray 100 for receiving water for making ice, a sensor device 700, or sensor module 700, installed on the ice tray 100 to measure a horizontal position, ice making temperature, and the like, a sensor wire 800 transferring data measured by the sensor device 700 to a controller 900 of the refrigerator, a driver 30 provided at a first end of the ice tray 100 and including a controller, a motor, and the like, to rotate the ice tray 100, a driving rotational shaft 400 provided at the first end of the ice tray 100 and rotated by the motor of the driver 30, a rotational shaft support device 500 formed at a second end of the ice tray 100 opposite the first end/driver 30 and supporting the second end of the ice tray 100, and a support rotational shaft 300 formed at the second end of the ice tray 100 and supported by the rotational shaft support device 500, and having a through hole 330 allowing the sensor wire 800 to pass therethrough.

As shown in FIG. 2, the ice tray 100 may be rotated by about 180 degrees to release frozen ice downwardly from the ice tray 100. In this arrangement, the sensor wire 800 extends from the sensor device toward the support rotational shaft 300, rather than toward the driver 30. In order to prevent entanglement of the sensor wire 800, the sensor wire 800 passes through the hollow through hole 330 formed in the support rotational shaft 300 so as to be aligned along a central rotational axis, whereby the sensor wire 800 may be prevented from being cut off even when the ice tray 100 is rotated, and does not interfere with an operation of the ice tray 100.

The ice tray 100 may include a plurality of cells receiving water therein to make ice. The ice tray 100 may be made of silicon-based plastic which does not break at a low freezing temperature and may be twisted for releasing ice.

The driver 30 may be connected to the driving rotational shaft 400 at a central portion of the first end of the ice tray 100 and may include a controller, a gear motor, an electronic circuit, and the like, for rotating the ice tray 100. The ice tray 100 may rotate through a range of about 180 degrees according to driving of the driving rotational shaft 400 to automatically release ice.

The driving rotational shaft 400 may be connected to a motor shaft of the driver 30, and positioned at a central portion of the first end of the ice tray 100 to rotate the ice tray 100. Since the driving rotational shaft 400 is fixed in the driving unit 30, when the sensor wire 800 is drawn through the driving rotational shaft 400 as in the ice making apparatus shown in FIG. 1, the sensor wire 800 may be twisted when the ice tray 100 is rotated. Since the sensor device 700 is attached to a lower surface of the ice tray 100, the sensor wire 800 may be caught in the cover 200 according to a rotation of the ice tray 100 in the arrangement shown in FIG. 1 so as to be cut off or cause malfunction of the ice tray 100.

Figure 3:
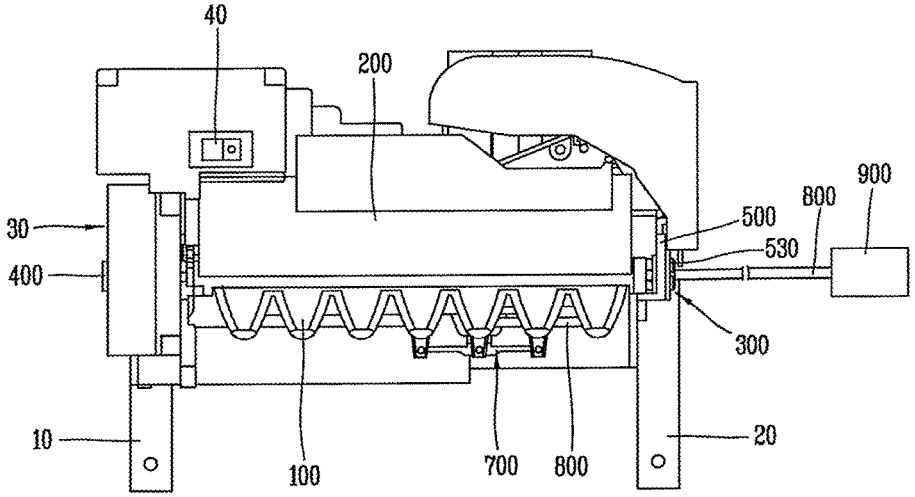
FIG. 3 is a lower elevation view of the ice making apparatus shown in FIG. 2.
Figure 4:
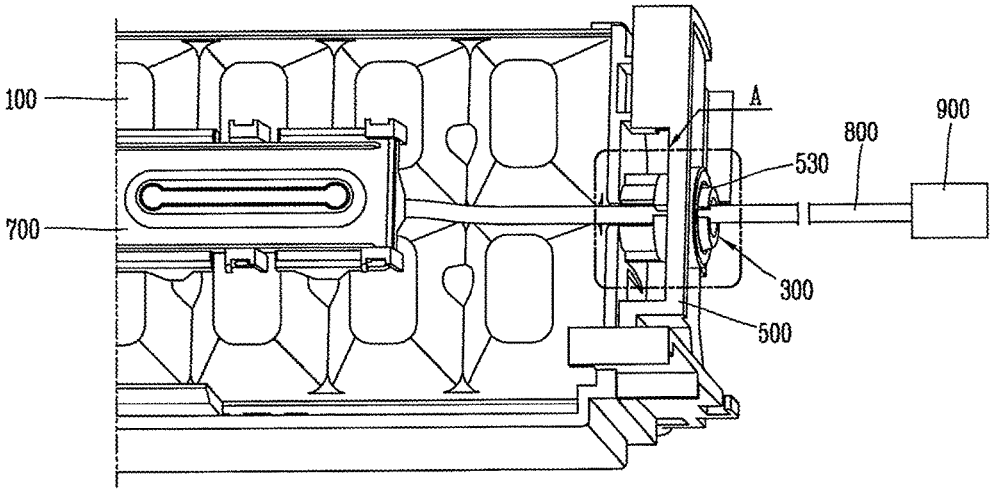
FIG. 4 is a partial bottom view illustrating of the ice making apparatus shown in FIGS. 2 and 3.

In the embodiment shown in FIGS. 2 through 4, the support rotational shaft 300 may be positioned at a central portion of a second end of the ice tray 100 opposite the first end thereof and opposite the driving rotational shaft 400. Thus, the driving rotational shaft 400 may rotate the ice tray 100 upon receiving rotary force from the motor of the driver 30. However, as shown in FIGS. 2 through 4, the support rotational shaft 300 may be formed as a hinge shaft which is hinge-rotated while being simply supported in a rotational shaft hole 530 (see FIGS. 3 and 4) of the rotational shaft support unit 500.

In the embodiment shown in FIGS. 2 through 4, the support rotational shaft 300 includes the through hole 330 allowing the sensor wire 800 to pass therethrough such that the sensor wire 800 is not twisted even as the ice tray 100 is rotated. Since the sensor wire 800 passes through the through hole 330 so as to be drawn out of the ice making apparatus toward the controller 900 of the refrigerator, even when the ice tray 100 is rotated, the sensor wire 800 will not be twisted or cut off.

The rotational shaft support device 500 includes the support rotational shaft 300 positioned at the second end of the ice tray 100, opposite the driver 30. The rotational shaft hole 530 is formed in the rotational shaft support device 500 to allow the support rotational shaft 300 to be inserted therein and hinge-rotated. An inner diameter of the rotational shaft hole 530 may be slightly greater than an outer diameter of the support rotational shaft 300. The driver 30 may be fixed to a first fixing device 10, such as a first fixing bracket or rod 10, and the rotational shaft support device 500 may be fixed to a second fixing device 20, such as a second fixing bracket or rod 20, to install the ice making apparatus on the door or the main body of the refrigerator, depending on where the ice making chamber is formed.

As shown in FIGS. 2 through 4, the sensor device 700 may be installed on a lower surface of the ice tray 100 to measure a horizontal position, an ice making temperature, and the like, of the ice tray 100. Data measured by the sensor device 700 may be transferred to the controller 900 of the refrigerator provided, for example, at a main body or a door of the refrigerator, via the sensor wire 800. Thus, a user may check ice making conditions and process based on the data, and may also check an ice making state and release frozen ice cubes from the ice tray 100.

The sensor wire 800 may be an electric wire that transfers the data measured by the sensor device 700 to the controller 900 of the refrigerator. For example, an electric wire 801*a* such as a copper wire, or the like, may be utilized as such an electric wire. Taking into consideration that the sensor wire 800 may be twisted as the ice tray 100 rotates, as illustrated in FIGS. 2 through 4, the electric wire 801*a* itself may be inserted in a silicon-based plastic tube 801*b* and electrically connected to the sensor device 700.

In certain embodiments, the sensor wire 800 may be formed as a conductive type jack or a connection terminal 801*c* having an end electrically inserted into and connected to the sensor device 700. In this case, a section of the end of the sensor wire 800 may be thicker than that of the silicon-based plastic tube, so the sensor wire 800 cannot be inserted into/coupled to the through hole 330 of the support rotational shaft 300. Thus, in one embodiment, the support rotational shaft 300 may include at least one cutaway portion allowing the through hole 330 to be exposed, whereby the sensor wire 800 may be press-fit into the through hole 330 through the at least one cutaway portion.

In the ice making apparatus described above, the driver 30 may be firmly fixed to the first fixing device 10 and the rotational shaft support device 500 may be firmly fixed to the second fixing device 20 to perform an ice making function at the inner side of the door or the main body of the refrigerator.

A switch 40 may be provided to control (e.g., switch on or off) an operation of the driver 30 for releasing ice. Namely, after ice making is completed, the switch 40 may be operated to rotate the motor of the driver 30, causing the ice tray 100 to rotate approximately 180 degrees to downwardly release ice cubes into the ice storage container.

Figure 5:
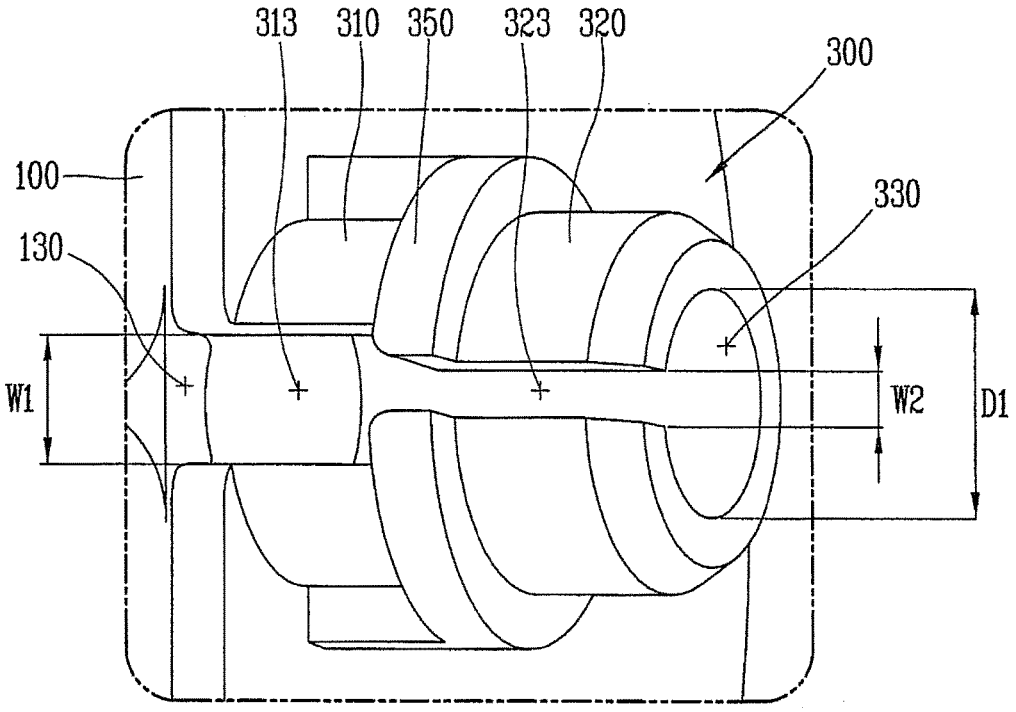
FIG. 5 is a detailed view of a support rotational shaft of the ice making apparatus shown in FIGS. 2-4.

As shown in FIG. 5, the support rotational shaft 300 may include cutaway portions 313 and 323 formed in a length direction along one side of the support rotational shaft 300 to expose the through hole 330. As illustrated in FIGS. 2 and 3, the sensor wire 800 drawn from the sensor device 700 attached to the lower surface of the ice tray 100 may be inserted into the through hole 330 of the support rotational shaft 300 and positioned in the central portion of the support rotational shaft 300 when the ice tray 100 is rotated. Thus, twisting and/or breakage of the sensor wire 800 may be prevented during rotation of the ice tray 100.

Referring to FIG. 5, the cutaway portions may include a first cutaway portion 313 allowing the sensor wire 800 to be inserted into the support rotational shaft 300, and a second cutaway portion 323 to guide the sensor wire 800 to through the through hole 330. The second cutaway portion 323 may prevent the sensor wire 800, once inserted therethrough, from being separated from the support rotational shaft 300, and the first cutaway portion 313 may allow the inserted sensor wire 800 to be easily received in the support rotational shaft 300. Thus, a cutaway width W1 of the first cutaway portion 313 may be greater than a cutaway width W2 of the second cutaway portion 323. In certain embodiments, the width W1 of the first cutaway portion 313 may be greater than a diameter of the sensor wire 800 to allow for easy insertion of the sensor wire 800, and the width W2 of the second cutaway portion 323 may be smaller than the diameter of the sensor wire 800 to prevent release of the sensor wire 800.

In addition, as shown in FIG. 5, the ice tray 100 may include a sensor wire guide 130 communicating with the first cutaway portion 313 to guide the sensor wire 800 between the first cutaway portion 313 and the sensor device 700 installed on the lower surface of the ice tray 100. As shown in FIGS. 4 and 5, the sensor wire guide 130 may be formed as a recess extending from the first cutaway portion 313 on a lower surface of a coupling portion of the ice tray 100 and the support rotational shaft 300.

In another embodiment, as illustrated in FIG. 5, the support rotational shaft 300 may include a first through portion 310 fixedly coupled to a lateral portion of the ice tray 100 and a second through portion 320 hinge-coupled to the rotational shaft support device 500. In certain embodiments, the first through portion 310 may be integrally coupled to a lateral surface of the ice tray 100, and the second through portion 320 may extend outward from the first through portion 310.

The first through portion 310 may include the first cutaway portion 313 through which the sensor wire 800 is drawn, and the second through portion 320 may include the second cutaway portion 323. As described above, the first cutaway portion 313 and the second cutaway portion 323 may have different cutaway widths W1 and W2. Referring to FIG. 5, the support rotational shaft 300 may also include a stop protrusion 350 allowing the support rotational shaft 300 to be caught by the rotational shaft hole 530 of the rotational shaft support device 500.

The second through portion 320 of the support rotational shaft 300 may be inserted into the rotational shaft hole 530 and hinge-rotated, and the stop protrusion 350 may prevent the support rotational shaft 300 inserted in the rotational shaft hole 530 from being pushed any further to the outside in an axial direction. To this end, an outer diameter of the stop protrusion 350 may be greater than an inner diameter D1 of the rotational shaft hole 530.

Also, as shown in FIG. 5, the stop protrusion 350 may protrude between the first through portion 310 and the second through portion 320 and may have an outer diameter greater than those of the first through portion 310 and the second through portion 320.

The ice tray 100 and the support rotational shaft 300 may be integrally formed.

A method for assembling the ice tray 100 and the sensor wire 800 through the support rotational shaft 300 in the ice making apparatus as embodied and broadly described herein will now be provided. In one embodiment, an assembling method may include inserting the sensor wire 800 into the rotational shaft hole 530 of the rotational shaft support device 500 and then press-fitting the sensor wire 800, which has been inserted into the rotational shaft hole 530, into the through hole 330 of the support rotational shaft 300 through the second cutaway portion 323. The sensor wire 800, which has been press-fit into the through hole 330 through the second cutaway portion 323, may then be drawn out through the first cutaway portion 313 of the support rotational shaft 300, and the support rotational shaft 300, which the sensor wire 800 penetrates, may be inserted into and coupled to the rotational shaft hole 530 of the rotational shaft support device 500. The sensor wire 800 may then be electrically connected to the sensor device 700.

In certain embodiments, when inserting the sensor wire 800 into the through hole 330 of the support rotational shaft 300, an intermediate portion of the inserted sensor wire 800 may be press-fit into the through hole 330 through the second cutaway portion 323 and drawn out through the first cutaway portion 313.

When a connection terminal 801*c* to be connected with the sensor device 700 is formed on an end portion of the sensor device 700 at which the sensor wire 800 is coupled, the connection terminal 801*c* may be formed as a jack, or the like, which is thicker than the through hole 330, so it may be difficult to insert/couple the end of the sensor wire 800 to the through hole 330. Thus, an intermediate portion, rather than an end, of the sensor wire 100 may be press-fit into the through hole 330 through the cutaway portions 313 and 323.

An ice making apparatus of a refrigerator is provided that is capable of preventing a sensor wire from being caught between a driver and a lateral portion of an ice tray so as to prevent possible malfunction of the ice tray and the ice making apparatus when the ice tray is rotated to release ice, and capable of preventing the sensor wire from being cut off when the sensor wire is caught between the driver and the lateral portion of the ice tray. A method for assembling such a sensor wire and such an ice making apparatus is also provided.

An ice making apparatus of a refrigerator is provided in which a sensor wire is drawn out toward a support rotational shaft of an ice tray to thus allow a driver and the ice tray to be rotated smoothly, thus preventing malfunction of the ice tray and the apparatus due to a sensor wire being caught between the driver and the ice tray. A method for assembling such a sensor wire and such an ice making apparatus is also provided.

An ice making apparatus of a refrigerator is provided in which a sensor wire is drawn out through a through hole of a support rotational shaft so as to be positioned in a rotation central axis such that the sensor wire is not affected by a rotation of an ice tray and is prevented from being cut off upon being twisted or caught. A method for assembling such a sensor wire and such an ice making apparatus is also provided.

An ice making apparatus of a refrigerator as embodied and broadly described herein may include an ice tray for accommodating water for making ice, a sensor unit installed at a lower portion of the ice tray, a sensor wire transferring data measured by the sensor unit to a controller 900 of the refrigerator, a driving unit formed at one side of the ice tray and including a controller or a motor to rotate the ice tray, a driving rotational shaft formed at one side of the ice tray and rotated by the motor of the driving unit; a rotational shaft support unit formed on the opposite side of the driving unit, supporting the other side of the ice tray, and having a rotational shaft hole, and a support rotational shaft formed on the other side of the ice tray, inserted into the rotational shaft hole of the rotational shaft support unit, rotatably supported therein, and having a through hole allowing the sensor wire to pass therethrough.

In one embodiment, the support rotational shaft may include a cutaway portion formed on one side of the support rotational shaft and allowing a through hole to be exposed in a length direction, and the cutaway portion may include a first cutaway portion allowing the sensor wire to be drawn out; and a second cutaway portion allowing the sensor wire to be pushed to be inserted therein.

The cutaway width of the first cutaway portion may be greater than that of the second cutaway portion.

In one embodiment, the support rotational shaft may include a first through portion fixedly coupled to a lateral portion of the ice tray, and a second through portion hinge-coupled to the rotational shaft support unit.

The first through portion may include a first cutaway portion through which the sensor wire is drawn out, the second through portion may include a second cutaway portion through which the sensor wire is press-fit, and the first cutaway portion may have a width greater than that of the second cutaway portion.

In one embodiment, the support rotational shaft may include a rotational shaft support unit stop protrusion allowing the support rotational shaft to be caught in the rotational shaft hole of the rotational shaft support unit. The rotational shaft support unit stop protrusion may be formed to be protruded between the first through portion and the second through portion, and have an outer diameter greater than that of the first through portion and the second through portion.

The ice tray and the support rotational shaft may be integrally formed.

In one embodiment, the ice tray may include a sensor wire guiding unit communicating with the first cutaway portion to guide the sensor wire drawn out from the first cutaway portion to the sensor unit from a lower portion of the ice tray.

The first cutaway portion may have a width greater than a diameter of the sensor wire, and the second cutaway portion may be cut out to have a width smaller than a diameter of the sensor wire.

In another embodiment as broadly described herein, an assembling method of an ice making apparatus of a refrigerator including an ice tray, a sensor unit, a sensor wire, a rotational shaft support unit, and a support rotational shaft formed in the ice tray, rotatably supported by the rotational shaft support unit, and having a through hole allowing the sensor wire to pass therethrough, may include a step of inserting the sensor wire into a rotational shaft hole of the rotational shaft support unit, a step of press-fitting the sensor wire, which has been inserted into the rotational shaft hole, into the through hole of the support rotational shaft through a second cutaway portion of the support rotational shaft; a step of drawing out the sensor wire, which has been press-fit into the through hole through the second cutaway portion, through the first cutaway portion of the support rotational shaft, a step of inserting/coupling the support rotational shaft, in which the sensor wire penetrates, to the rotational shaft hole of the rotational shaft support unit; and a step of mounting the sensor wire such that it is electrically connected to the sensor unit.

In the step of inserting the sensor wire into the through hole of the support rotational shaft, an intermediate portion of the inserted sensor wire may be press-fit into the through hole through the second cutaway portion of the support rotational shaft and drawn out through the first cutaway portion.

According to embodiments of the system and method as broadly described herein, when the ice tray is rotated so as to reverse its position by approximately 180 degrees for releasing ice, a sensor wire may be prevented from being caught between a driver and a lateral portion of an ice tray, thus preventing possible malfunction.

Because the sensor wire is drawn out toward a support rotational shaft of the ice tray, the driver and the ice tray may be smoothly rotated, thus preventing malfunction due to the sensor wire being caught.

Additionally, since the sensor wire is drawn out through a through hole of a support rotational shaft so as to be positioned at a rotation central shaft, the sensor wire is not affected by a rotation of the ice tray, and since the sensor wire is not twisted or caught, the sensor wire is prevented from being cut off.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An ice making apparatus of a refrigerator, comprising:

an ice tray that accommodates water for making ice;

a sensor installed on a lower surface of the ice tray;

a sensor wire having a first end connected to the sensor and a second end configured to be connected to a controller of the refrigerator to transfer data therebetween;

a driver provided at a first end of the ice tray;

a drive rotational shaft formed on the first end of the ice tray and coupled to the driver to be rotated by the driver;

a rotational shaft support device provided at a second end of the ice tray opposite the first end thereof, that supports the second end of the ice tray, the rotational shaft support device having a rotational shaft hole; and a support rotational shaft formed on the second end of the ice tray and inserted into the rotational shaft hole of the rotational shaft support device, the support rotational shaft having a through hole formed therein that guides the sensor wire therethrough such that the sensor wire is prevented from being twisted or cut off when the ice tray is rotated, wherein the first end of the sensor wire includes a connection terminal connected to the sensor, the connection terminal being thicker than the through hole, wherein the support rotational shaft includes:

a first through portion fixed to the second end of the ice tray;

a second through portion that extends outward from the first through portion and is coupled to the rotational shaft hole of the rotational shaft support device to be rotatable;

a stop protrusion provided between the first and second through portions, that engages the rotational shaft hole of the rotational shaft support device to limit lateral movement of the support rotational shaft;

a first cutaway formed in the first through portion and the stop protrusion, that exposes a corresponding portion of the through hole and is configured to allow an intermediate portion of the sensor wire between the first end and the second end of the sensor wire to be withdrawn out of the through hole; and a second cutaway formed in the second through portion, that exposes a corresponding portion of the through hole and is configured to receive the intermediate portion between the first end and the second end of the sensor wire, wherein a width of the second cutaway is less than a diameter of the sensor wire such that the sensor wire is press-fit into the through hole through the second cutaway, to be prevented from being released therefrom, wherein a width of the first cutaway is greater than the diameter of the sensor wire to allow for easy insertion and withdrawal of the sensor wire, wherein a diameter of the through hole is greater than the width of the first cutaway, the width of the second cutaway, and the diameter of the sensor wire, and wherein the second cutaway is blocked by the rotational shaft support device when the support rotational shaft is inserted into the rotational shaft hole.

2. The ice making apparatus of claim 1, wherein the ice tray includes a sensor wire guide in communication with the first cutaway to guide the sensor wire from the first cutaway to the sensor at the lower surface of the ice tray.

3. The ice making apparatus of claim 1, wherein an outer diameter of the stop protrusion is greater than an outer diameter of the first through portion and greater than an outer diameter of the second through portion.

4. The ice making apparatus of claim 1, wherein the ice tray and the support rotational shaft are integrally formed.

5. A method of assembling an ice malting apparatus of a refrigerator including an ice tray, a sensor, a sensor wire having a first end connected to the sensor and a second end configured to be connected to a controller of the refrigerator to transfer data therebetween, the first end having a connection terminal connected to the sensor, a rotational shaft support device, and a support rotational shaft including a through hole formed therein that guides the sensor wire therethrough such that the sensor wire is prevented from being twisted or cut off when the ice tray is rotated, a first through portion fixed to an end of the ice tray, a second through portion that extends outward from the first through portion, a stop protrusion provided between the first and the second through portions, a first cutaway formed in the first through portion and the stop protrusion and a second cutaway portion formed in the second through portion, wherein the support rotational shaft is supported by the rotational shaft support device to be rotatable, the first and second cutaways expose corresponding portions of the through hole formed therein, respectively, the connection terminal is thicket than the through hole, a width of the second cutaway is less than a with of the sensor wire, a width of the first cutaway is greater than the width of the sensor wire, and a diameter of the through hole is greater than the widths of the first and second cutaways and the width of the sensor wire, the method comprising:

inserting the sensor wire through a rotational shaft hole formed in the rotational shaft support device;

press-fitting the sensor wire into the through hole formed in the support rotational shaft through the second cutaway of the support rotational shaft;

drawing the sensor wire out of the through hole through the first cutaway of the support rotational shaft;

coupling the second through portion of the support rotational shaft, having the sensor wire having a portion received in the through hole provided with the second through portion, to the rotational shaft hole of the rotational shaft support device, wherein second cutaway is blocked by the rotational shaft support device when the second through portion is coupled to the rotational shaft hole; and electrically connecting the connection terminal of the sensor wire to the sensor.

6. The method of claim 5, wherein press fitting the sensor wire into the through hole and drawing the sensor wire out of the through hole includes press fitting an intermediate portion of the sensor wire into the through hole through the second cutaway of the support rotational shaft and then drawing an adjacent portion of the sensor wire out through the first cutaway.

* * * * *